US011780218B2

(12) United States Patent
Street et al.

(10) Patent No.: US 11,780,218 B2
(45) Date of Patent: Oct. 10, 2023

(54) MATRIX-ADDRESSED HEAT IMAGE FORMING DEVICE

(71) Applicant: Palo Alto Research Center Incorporated, Palo Alto, CA (US)

(72) Inventors: Robert A. Street, Palo Alto, CA (US); Jengping Lu, Fremont, CA (US); Joerg Martini, San Francisco, CA (US); David K. Biegelsen, Portola Valley, CA (US); Thomas Wunderer, Santa Cruz, CA (US)

(73) Assignee: Xerox Corporation, Norwalk, CT (US)

( * ) Notice: Subject to any disclaimer, the term of this patent is extended or adjusted under 35 U.S.C. 154(b) by 78 days.

(21) Appl. No.: 17/494,208

(22) Filed: Oct. 5, 2021

(65) Prior Publication Data

US 2022/0227115 A1 Jul. 21, 2022

Related U.S. Application Data

(60) Provisional application No. 63/139,181, filed on Jan. 19, 2021.

(51) Int. Cl.
*B41C 1/10* (2006.01)
*B41F 31/00* (2006.01)
(Continued)

(52) U.S. Cl.
CPC ..... *B41F 13/08* (2013.01); *B41C 1/1041* (2013.01); *B41F 7/02* (2013.01); *B41F 7/08* (2013.01);
(Continued)

(58) Field of Classification Search
CPC ..... B41J 2/33515; B41J 2/33535; B41J 2/34; B41J 2/355; B41C 1/1033; B41C 1/1041;
(Continued)

(56) References Cited

U.S. PATENT DOCUMENTS 7,952,599 B2 * 5/2011 Zhou ..... B41M 7/009 347/171
2010/0251914 A1 * 10/2010 Zhou ..... B41M 5/368 101/453
(Continued)

OTHER PUBLICATIONS

Co-Pending U.S. Appl. No. 17/462,043, filed Aug. 31, 2021.

*Primary Examiner* — Jennifer Bahls
*Assistant Examiner* — Quang X Nguyen
(74) *Attorney, Agent, or Firm* — Caesar Rivise, PC

(57) ABSTRACT

Based on evaporation of fountain solution from a rotating blanket cylinder to create an image that may be inked and printed, a digitally addressable heater array at or just below the blanket surface evaporates deposited fountain solution and forms a fountain solution latent image on the surface. The heater array has controllable heating elements (e.g., field effect transistors, thin film transistors) that provide a transient heat pattern on the surface to evaporate the fountain solution. Heat is generated by current flow in the heating elements, and power developed by the heating circuit is the product of source-drain voltage and current in the channel. Current may be supplied along data lines by an external voltage controlled by digital electronics to provide the desired heat at heating elements addressed by a specific gate line. The heater array may include a current return line that may be a 2-dimensional mesh.

23 Claims, 13 Drawing Sheets

(51) Int. Cl.

| | |
|---|---|
| ***B41F 7/02*** | (2006.01) |
| ***B41F 13/08*** | (2006.01) |
| ***B41J 2/34*** | (2006.01) |
| ***B41J 2/335*** | (2006.01) |
| ***B41F 7/08*** | (2006.01) |
| ***B41F 7/26*** | (2006.01) |
| ***B41M 1/06*** | (2006.01) |
| ***B41F 31/13*** | (2006.01) |
| ***B41F 31/08*** | (2006.01) |
| ***B41N 3/03*** | (2006.01) |

(52) U.S. Cl.
CPC ..... *B41F 7/26* (2013.01); *B41F 31/002* (2013.01); *B41F 31/08* (2013.01); *B41F 31/13* (2013.01); *B41J 2/33535* (2013.01); *B41J 2/34* (2013.01); *B41M 1/06* (2013.01); *B41N 3/03* (2013.01); *B41C 1/1033* (2013.01); *B41P 2227/70* (2013.01)

(58) Field of Classification Search
CPC ..... B41F 7/02; B41F 7/08; B41F 7/26; B41F 31/002; B41F 31/08; B41F 31/13
See application file for complete search history.

(56) References Cited

U.S. PATENT DOCUMENTS

| | | | | |
|---|---|---|---|---|
| 2012/0103212 | A1 | 5/2012 | Stowe et al. | |
| 2012/0103221 | A1 | 5/2012 | Stowe et al. | |
| 2016/0067953 | A1* | 3/2016 | Teng ..... | B41M 1/06 101/450.1 |

* cited by examiner

MATRIX-ADDRESSED HEAT IMAGE FORMING DEVICE

CROSS-REFERENCE TO RELATED APPLICATIONS

This application claims the benefit under 35 U.S.C. § 119(e) of Application Ser. No. 63/139,181 filed on filed on Jan. 19, 2021 entitled NEXT GENERATION FOUNTAIN SOLUTION IMAGE FORMATION AND TRANSFER and whose entire disclosure is incorporated by reference herein.

FIELD OF DISCLOSURE

This invention relates generally to digital printing systems, and more particularly, to heat image forming systems and methods for selective thermal transfer useable in lithographic offset printing systems.

BACKGROUND

Offset lithography is a common method of printing today. For the purpose hereof, the terms "printing" and "marking" are interchangeable. In a typical lithographic process, a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high-power laser module adds a significant cost to the system; it also limits the achievable print speed to about five meters per second (5 m/s) and may compromise the lifetime of the exposed components (e.g., micro-mirror array, imaging blanket, plate, or drum). Substituting less powerful image creating sources such as a conventional Raster Output Scanner (ROS) has been proposed. However, to evaporate a one (1) micron thick film of water, at process speed requirements of up to five meters per second (5 m/s), requires on the order of 100,000 times more power than a conventional xerographic ROS imager. In addition, cross-process width requirements are on the order of 36 inches, which makes the use of a scanning beam imager problematic. Thus, a special imager design is required that reduces power consumption in a printing system.

For the reasons stated above, and for other reasons which will become apparent to those skilled in the art upon reading and understanding the present specification, it would be beneficial to increase speed, lower power consumption, or find non-optical approaches of delivering power in variable data lithography system.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a heat image forming device useful in printing with an image forming device having a rotatable reimageable latent imaging roll. The heat image forming device includes a heating array and driving circuitry. The heating array is disposed as a layer of the rotatable reimageable latent imaging roll proximate an outer surface of the latent imaging roll. The heating array includes a pixelated array of controllable heating elements spread about the layer with each heating element corresponding to a respective pixel of the pixelated array, wherein a fluid (e.g., fountain solution) is deposited over the rotatable reimageable latent imaging roll. Each heating element of the heating array is heated by electric current and thereby electronically controllable. The driving circuitry is communicatively connected to the heating array for selectively temporarily heating the heating elements in a patterned image to an elevated temperature. The selectively temporarily heated heating elements are configured to heat portions of the rotatable reimageable latent imaging roll outer surface proximate the heating array as a heated patterned image when the selected heating elements are at the elevated temperature. The heated patterned image is configured to modify the deposited fluid over the rotatable reimageable latent imaging roll to produce a latent image of the deposited fluid on the rotatable reimageable latent imaging roll surface based on the patterned image.

According to aspects illustrated herein, an exemplary method of forming a latent image of fountain solution on a rotatable reimageable latent imaging roll of a digital image forming device using a heat image forming device includes depositing a fountain solution over a surface of the rotatable reimageable latent imaging roll, driving of driving circuitry to selectively switch the heating elements and heat the rotatable reimageable latent imaging roll surface in the patterned image to form the heated patterned image thereon, and modifying the deposited fountain solution over the rotatable reimageable latent imaging roll surface to the latent image via interaction of the deposited fountain solution with the heated patterned image to produce the latent image of fountain solution on the rotatable reimageable latent imaging roll.

According to aspects described herein, an exemplary method of forming a latent image of fountain solution on a rotatable reimageable latent imaging roll of a digital image forming device using a heat image forming device includes driving of driving circuitry to selectively switch heating elements of a heating array and heat the rotatable reimageable latent imaging roll surface in a patterned image to form a heated patterned image thereon, vapor depositing a fountain solution over the surface of the rotatable reimageable latent imaging roll, and the heated patterned image modifies the deposited fountain solution over the rotatable reimageable latent imaging roll to produce the latent image of fountain solution on the rotatable reimageable latent imaging roll surface based on the heated patterned image.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
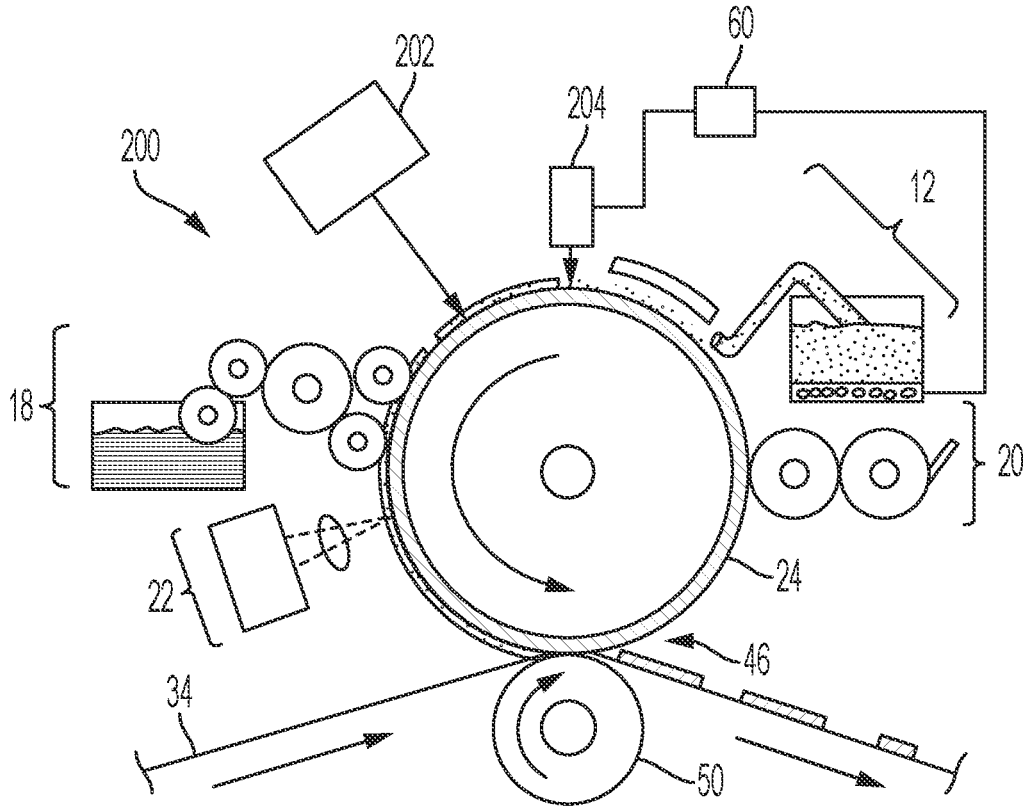
FIG. 1 RELATED ART
FIG. 1 is a block diagram of a related art ink-based digital image forming device.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

Although embodiments of the invention are not limited in this regard, discussions utilizing terms such as, for example, "processing," "computing," "calculating," "determining," "using," "establishing", "analyzing", "checking", or the like, may refer to operation(s) and/or process(es) of a controller, computer, computing platform, computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roller) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may include Octamethylcyclotetrasiloxane (D4) or Decamethylcyclopentasiloxane (D5) dampening fluid alone, mixed, and/or with wetting agents. The fountain solution may also include Isopar G, Isopar H, Dowsil OS10, Dowsil OS20, Dowsil OS30, and mixtures thereof.

Inking systems or devices may be incorporated into digital offset image forming device architecture so that the inking system is arranged about a central imaging plate, also referred to as an imaging member. In such a system, the imaging member is a rotatable imaging member, including a conformable blanket around a cylindrical drum with the conformable blanket including the reimageable surface. This blanket layer has specific properties such as composition, surface profile, and so on so as to be well suited for receipt and carrying a layer of a fountain solution. A surface of the imaging member is reimageable making the imaging member a digital imaging member. The surface is constructed of elastomeric materials and conformable. A paper path architecture may be situated adjacent the imaging member to form a media transfer nip.

A layer of fountain solution may be deposited in liquid, vapor and/or particle form to the surface of the imaging member by a dampening fluid station. In a digital evaporation step, particular portions of the fountain solution layer deposited onto the surface of the imaging member may be evaporated by a digital evaporation system. Conventionally, portions of the fountain solution layer may be vaporized by an optical patterning subsystem such as a scanned, modulated laser that patterns the fluid solution layer to form a latent image. In a vapor removal step, the vaporized fountain solution may be collected by a vapor removal device or vacuum to prevent condensation of the vaporized fountain solution back onto the imaging plate.

In an inking step, ink may be transferred from an inking system to the surface of the imaging member such that the ink selectively resides in evaporated voids formed by the patterning subsystem in the fountain solution layer to form an inked image. In an image transfer step, the inked image is then transferred to a print substrate such as paper via pressure at the media transfer nip.

In a digital variable printing process, previously imaged ink must be removed from the imaging member surface to prevent ghosting. After an image transfer step, the surface of the imaging member may be cleaned by a surface cleaning system so that the printing process may be repeated. For example, tacky cleaning rollers may be used to remove residual ink and fountain solution from the surface of the imaging member.

FIG. 1 depicts a related art ink-based digital printing system 200 for variable data lithography according to one embodiment of the present disclosure. System 200 comprises an imaging member 24 or arbitrarily reimageable surface since different images can be created on the surface layer, in this embodiment a blanket on a drum, but may equivalently be a plate, belt, or the like, surrounded by a dampening fluid station 12 (e.g., condensation-based, fluid delivery), optical patterning subsystem 202, inking apparatus 18, transfer station 46 for transferring an inked image from the surface of imaging member 24 to a substrate 34, and finally surface cleaning system 20. Other optional elements include a rheology (complex viscoelastic modulus) control subsystem 22, a thickness measurement subsystem 204, control subsystem 60, etc. Many additional optional subsystems may also be employed, but are beyond the scope of the present disclosure. As noted above, optical patterning subsystem 202 is complex, expensive, and accounts for the majority of total power consumption of the whole system 200.

Figure 2:
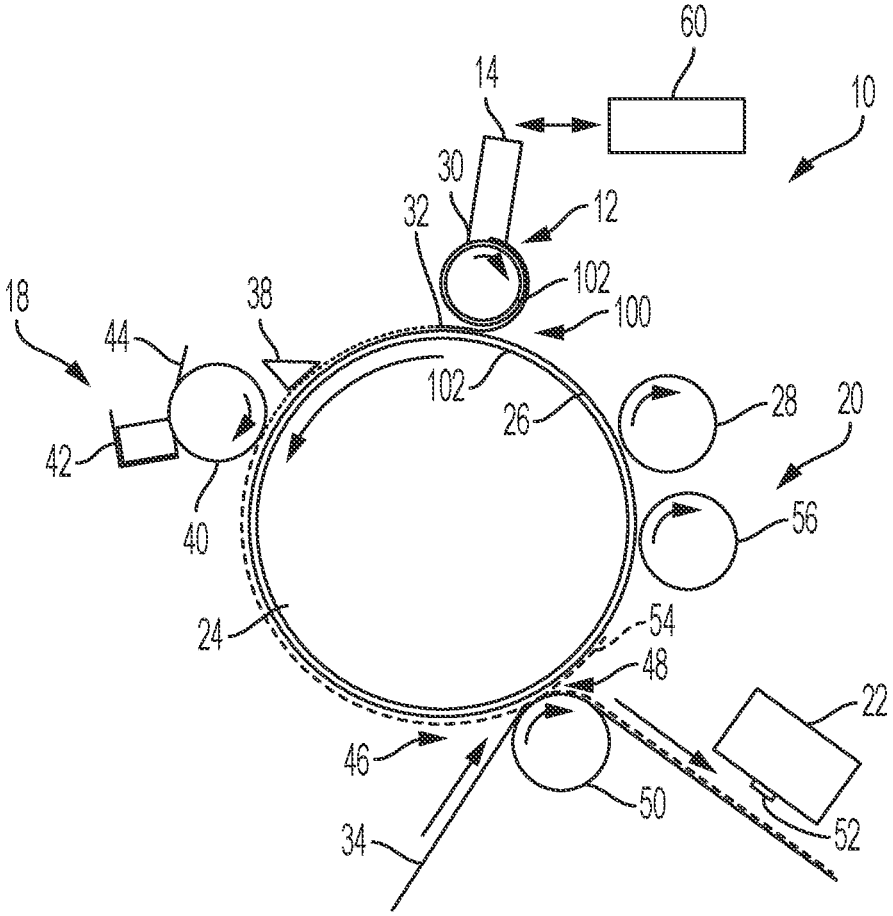
FIG. 2 is a perspective view of an exemplary fountain solution applicator.
Figure 3:
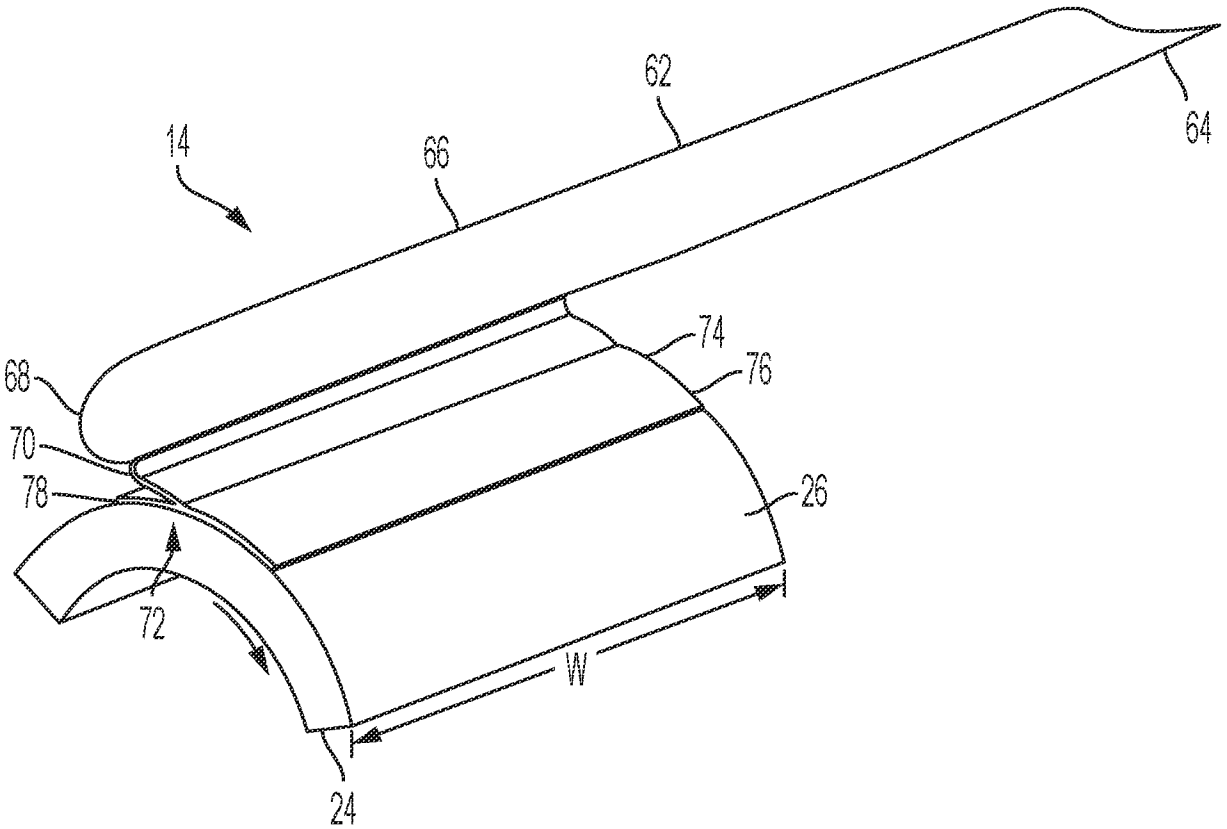
FIG. 3 is a block diagram of a digital image forming device in accordance with examples of the embodiments.

FIG. 2 depicts a digital image forming device 10 for variable data lithography according to examples of the embodiments. The image forming device 10 may include dampening fluid station 12 having fountain solution applicator 14, heat image forming device 100, inking apparatus 18, and a cleaning device 20. The image forming device 10 may also include one or more rheological conditioning subsystems 22 as discussed, for example, in greater detail below. FIG. 3 shows the fountain solution applicator 14 arranged with a digital imaging member 24 having a reimageable surface 26. While FIG. 2 shows components that are formed as rollers, other suitable forms and shapes may be implemented.

The imaging member surface 26 may be wear resistant and flexible. The surface 26 may be reimageable and conformable, having an elasticity and durometer, and sufficient flexibility for coating ink over a variety of different media types having different levels of roughness. A thickness of the reimageable surface layer may be, for example, about 0.5 millimeters to about 4 millimeters. The surface 26 should have a weak adhesion force to ink, yet good oleophilic wetting properties with the ink for promoting uniform inking of the reimageable surface and subsequent transfer lift of the ink onto a print substrate.

The soft, conformable surface 26 of the imaging member 24 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. Wetting surfactants, such as silicone glycol copolymers, may be added to the fountain solution to allow the fountain solution to wet the reimageable surface 26. The imaging member 24 may include conformable reimageable surface 26 of a blanket or belt wrapped around a roll or drum. The imaging member surface 26 may be temperature controlled to aid in a printing operation. For example, the imaging member 24 may be cooled internally (e.g., with chilled fluid) or externally (e.g., via a blanket chiller roll to a temperature (e.g., about 10° C.-60° C.) that may aid in the image forming, transfer and cleaning operations of image forming device 10.

Referring back to FIG. 1, the related art imaging member 24 has a surface layer known to incorporate a radiation sensitive filler material that can absorb laser energy or other highly directed energy in an efficient manner. It should be noted that the imaging member surface depicted in FIGS. 2 and 3 may not require the same limitation of radiation sensitive materials, as examples do not use or require laser energy. Thus, the imaging member surfaces depicted in FIGS. 2 and 3 allow better fluoro-silicone plate fabrication optimization without the need for carbon loading for related art NIR laser absorption.

The fountain solution applicator 14 may be configured to deposit a layer of fountain solution at a dispense rate onto the imaging member surface 26 and form a fountain solution layer 32 thereon directly or via an intermediate member (e.g., roller 30 (FIG. 2)) of the dampening fluid station 12. While not being limited to particular configuration, as can be seen in the example of FIG. 2, the fountain solution applicator 14 may include a series of rollers, sprays or a vaporizer (not shown) for uniformly wetting the reimageable surface 26 with a uniform layer of fountain solution with the thickness of the layer being controlled. The series of rollers may be considered as dampening rollers or a dampening unit, for uniformly wetting the reimageable surface 26 with a layer of fountain solution. The fountain solution may be applied by fluid or vapor deposition to create the thin fluid fountain solution layer 32 (e.g., between about 0.01 μm and about 1.0 μm in thickness, less than 5 μm, about 30 nm to 70 nm) of the fountain solution for uniform wetting and pinning. The applicator 14 may include a slot at its output across the imaging member 26 or intermediate roller 30 to output fountain solution to the imaging member surface 26.

FIG. 3 depicts another exemplary fountain solution applicator 14 that may apply a fountain solution layer directly onto the imaging member surface 26 or intermediate member. The fountain solution applicator 14 includes a supply chamber 62 that may be generally cylindrical defining an interior for containing fountain solution vapor therein. The supply chamber 62 includes an inlet tube 64 in fluid communication with a fountain solution supply (not shown), and a tube portion 66 extending to a closed distal end 68 thereof. A supply channel 70 extends from the supply chamber 62 to adjacent the imaging member surface 26, with the supply channel defining an interior in communication with the interior of the supply chamber to enable flow of fountain solution vapor from the supply chamber through the supply channel and out a supply channel outlet slot 72 for deposition over the imaging member surface, where the fountain solution vapor condenses to a fluid on the imaging member surface 26. In a similar manner the fountain solution applicator 14 in certain examples may deposit fountain solution vapor from the supply channel over an intermediate roller 30 that may then transfer the fountain solution directly or indirectly to the imaging member surface.

Still referring to FIG. 3, a vapor flow restriction baffle 74 extends from the supply channel 70 adjacent the reimageable surface 26 to confine fountain solution vapor provided from the supply channel outlet slot 72 to a condensation region defined by the restriction baffle and the adjacent reimageable surface to support forming a layer of fountain solution on the reimageable surface via condensation of the fountain solution vapor onto the reimageable surface. The restriction baffle 74 defines the condensation region over the surface 26 of the imaging member 24. The restriction baffle includes arc walls 76 that face the imaging member surface 26, and baffle wall 78 that extends from the arc walls towards the imaging member surface. The reimageable surface 26 of the imaging member 24 may have a width W parallel to the supply channel 70 and supply channel outlet slot 72, with the outlet slot having a width across the imaging member configured to enable fountain solution vapor in the supply chamber interior to communicate with the imaging member surface across its width. In examples where the fountain solution applicator 14 deposits fountain solution vapor onto the imaging member surface 26 that condenses to form the fountain solution layer 32, excess vapor may be collected and removed after sufficient condensation, for example, via a vacuum or other vapor removal device (not shown) to prevent condensation of the vaporized fountain solution back onto the imaging plate.

Referring back to FIG. 2, the heat image forming device 100 may selectively pattern a latent image in the layer of fountain solution by image-wise patterning using a digitally addressable heating array 102 that may be disposed as a layer of the imaging member 24 proximate or at the outer reimageable surface 26 thereof. In examples, the fountain solution layer 32 is exposed to the heating array that selectively applies heat to pixel sized portions of the layer to image-wise evaporate the fountain solution and create a latent "negative" of a marking material (e.g., ink, toner) image that may be desired to be printed on a receiving substrate 34. Image areas are created where ink is desired, and non-image areas are created where the fountain solution remains. It should be noted that examples are not limited to the heat image forming device 100 selectively heating pattern image portions of the fountain solution layer 32 after the fountain solution layer is deposited on the reimageable surface, as the heating array may also selectively heat the reimageable surface before or during fountain solution deposition onto the reimageable surface, as understood by a skilled artisan. Selectively heating the reimageable surface before fountain solution deposition is an imager approach that further reduces power consumption in printing systems (e.g., image forming devices 10), as it may require even less power to stop fountain solution vapor condensation on a reimageable imaging roll pre-heated heating element pixel than to evaporate pre-deposited fountain solution. Both approaches, along with simultaneous heating and deposition are considered within the scope of the examples. It should also be noted that in examples the heat image forming device 100 may be disposed as a layer of an intermediate roller 30 to selectively pattern a latent image of fountain solution on the intermediate roller that is then transferred to the imaging member surface 26. Accordingly, for illustration purposes the heat image forming device 100 may be seen in the example of FIG. 2 disposed as a layer of the imaging member 24 and in an alternative or addition as a layer of the intermediate roller 30, both being examples of a rotatable reimageable latent imaging roll.

In examples, a heat image forming device 100 provides a transient heat pattern to the surface of the roller (e.g., imaging member 24, intermediate roller 30) of a pixelated heat image that may evaporate fountain solution to arrive at a latent image on the roller. In aspects of the approach, a heating circuit having an array 102 of switching or controllable heating elements (e.g., field effect transistors (FETs), thin film transistors (TFTs)) is discussed. Heat is generated by current flow in the heating elements, and the power developed by the heating elements is the product of the source-drain voltage and the current in the heating element channel, which is proportional to the effective carrier mobility. Digital addressing may be accomplished by matrix addressing the array, for example, with orthogonal gate and data address lines. Current may be supplied along the data lines by an external voltage controlled by known digital electronic driving circuitry as understood by a skilled artisan to provide the desired heat at a respective pixel addressed by a specific gate line. The heat image forming device 100 may include a current return line that in examples may have a nominal ground potential and can be made low resistance, for example, by using a 2-dimensional mesh.

Benefits include the ability to heat at pixel-sized areas in an addressable fashion so that inexpensive circuit heating might be used at least in the architecture discussed herein. Such a heat image forming device may include an array of heating elements that are controllable (e.g., switchable, analog variable, pulse width modulation) digitally addressable, and scalable in pixel size and array size. The heating elements may each have a separate small transistor, meaning the amount of charge needed to control it is also small. This allows for very fast re-drawing of the controllable heating elements to pattern the latent image.

A vapor vacuum 38 or air knife may be positioned downstream the image-wise fountain solution layer 32 patterned evaporation to collect vaporized fountain solution and thus avoid leakage of excess fountain solution into the environment. Reclaiming excess vapor prevents fountain solution from depositing uncontrollably prior to the inking apparatus 18 and imaging member 24 interface. The vapor vacuum 38 may also prevent fountain solution vapor from entering the environment. Reclaimed fountain solution vapor can be condensed, filtered and reused as understood by a skilled artisan to help minimize the overall use of fountain solution by the image forming device 10.

Following patterning of the fountain solution layer by the heat image forming device 100, the patterned layer over the reimageable surface 26 is presented to the inking apparatus 18. The inker apparatus 18 is configured to apply a uniform layer of ink over the latent image of fountain solution and the reimageable surface layer 26 of the imaging member 24. The inking apparatus 18 may deposit the ink to the evaporated pattern representing the imaged portions of the reimageable surface 26, and ink deposited on the unformatted portions of the fountain solution do not adhere based on a hydrophobic and/or oleophobic nature of those portions. The inking apparatus may heat the ink before it is applied to the surface 26 to lower the viscosity of the ink for better spreading into imaged portion pockets of the reimageable surface. For example, one or more rollers 40 of the inking apparatus 18 may be heated, as well understood by a skilled artisan. Inking roller 40 is understood to have a structure for depositing marking material onto the reimageable surface layer 26, and may include an anilox roller or an ink nozzle. Excess ink may be metered from the inking roller 40 back to an ink container 42 of the inker apparatus 18 via a metering member 44 (e.g., doctor blade, air knife).

Although the marking material may be an ink, the disclosed embodiments are not intended to be limited to such a construct or type of ink. For example, the type of ink is not limited to an ink that hardens when exposed to UV radiation, at least because imaging is not provided by laser or other UV radiation. The ink may have a cohesive bond that increases, for example, by increasing its viscosity. For example, the ink may be a solvent ink or aqueous ink that thickens when cooled and thins when heated.

Downstream the inking apparatus 18 in the printing process direction resides ink image transfer station 46 that transfers the ink image from the imaging member surface 26 to a print substrate 34. The transfer occurs as the substrate 34 is passed through a transfer nip 48 between the imaging member 24 and an impression roller 50 such that the ink within the imaged portion pockets of the reimageable surface 26 is brought into physical contact with the substrate 34 and transfers via pressure at the transfer nip from the imaging member surface to the substrate as a print of the image.

Rheological conditioning subsystems 22 may be used to increase the viscosity and/or help cure the ink at specific locations of the digital image forming device 10 as desired. While not being limited to a particular theory, rheological conditioning subsystem 22 may include a curing mechanism 52, such as a UV curing lamp, wavelength tunable photoinitiator, or other UV source, that exposes the ink to an amount of UV light to at least partially cure the ink/coating to a tacky or solid state. The curing mechanism may include various forms of optical or photo curing, thermal curing, electron beam curing, drying, or chemical curing. In the exemplary image forming device 10 depicted in FIG. 2, rheological conditioning subsystem 22 may be positioned adjacent the substrate 34 downstream the ink image transfer station 46 to cure the ink image transferred to the substrate. Rheological conditioning subsystems 22 may also be positioned adjacent the imaging member surface 26 between the ink image transfer station 46 and cleaning device 20 as a preconditioner to harden any residual ink 54 for easier removal from the imaging member surface 26 that prepares the surface to repeat the digital image forming operation.

This residual ink removal is most preferably undertaken without scraping or wearing the imageable surface of the imaging member. Removal of such remaining fluid residue may be accomplished through use of some form of cleaning device 20 adjacent the surface 26 between the ink image transfer station 46 and the fountain solution applicator 14. Such a cleaning device 20 may include at least a first cleaning member 56 such as a sticky or tacky roller in physical contact with the imaging member surface 26, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste. It is understood that the cleaning device 20 is one of numerous types of cleaning devices and that other cleaning devices designed to remove residual ink/fountain solution from the surface of imaging member 24 are considered within the scope of the embodiments. For example, the cleaning device could include at least one roller, brush, web, belt, tacky roller, buffing wheel, etc., as well understood by a skilled artisan.

Figure 17:
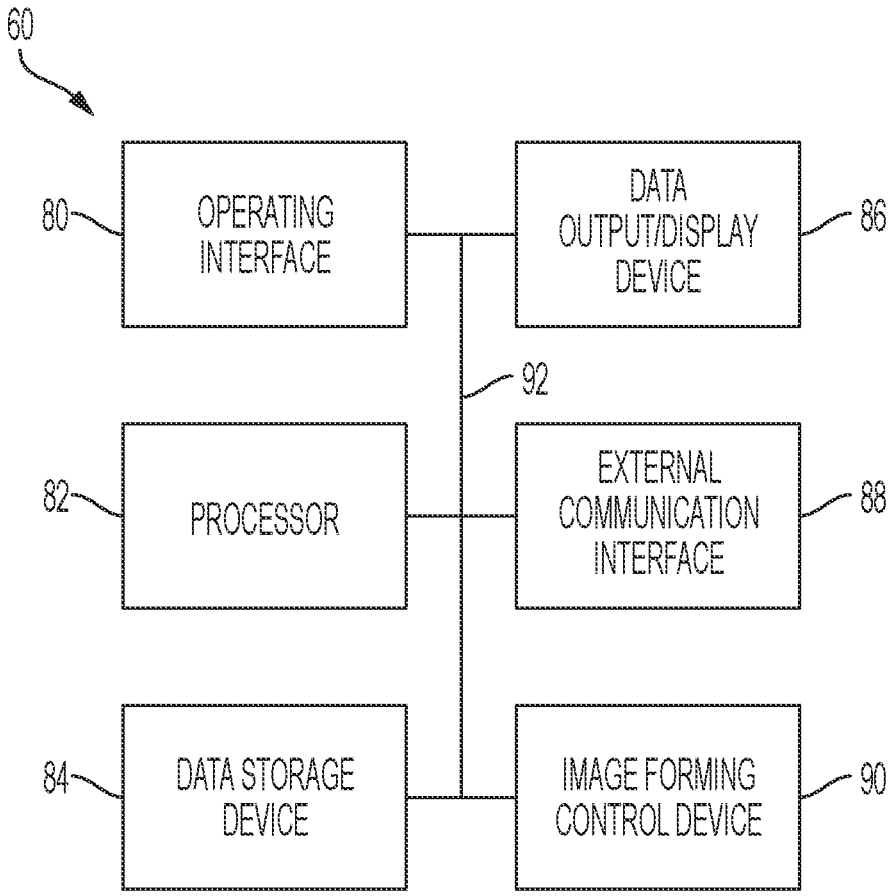
FIG. 17 is a block diagram of a controller with a processor for executing instructions to form a latent image in a digital image forming device.

In the image forming device 10, functions and utility provided by the dampening fluid station 12, heat image forming device 100, inking apparatus 18, cleaning device 20, rheological conditioning subsystems 22, and imaging member 24 may be controlled, at least in part by controller 60. Such a controller 60 is shown in FIGS. 2 and 17, and may be further designed to receive information and instructions from a workstation or other image input devices (e.g., computers, smart phones, laptops, tablets, kiosk) to coordinate the image formation on the print substrate through the various subsystems such as the dampening fluid station 12, heat image forming device 100, inking apparatus 18, and imaging member 24 as discussed in greater detail herein and understood by a skilled artisan.

Figure 4:
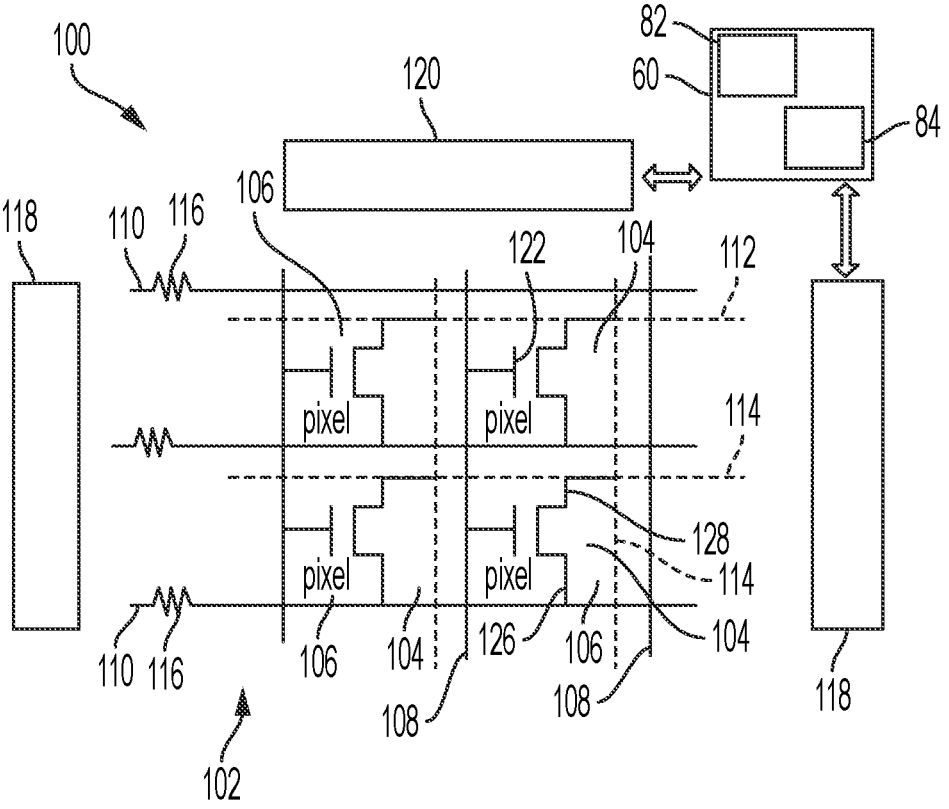
FIG. 4 is a diagram illustrating a heat image forming device in accordance with examples of embodiments.

FIG. 4 depicts an exemplary heat image forming device 100 having a circuit arranged as an array 102 of heating elements 104 that are controllable between an "on" heating state and an "off" heating or non-heating state. The controllable heating elements 104 are switchable, for example via digital, binary, analog, or pulse width modulation approaches as understood by a skilled artisan. Each heating element 104 includes a switch-device, which actively maintains the heating state while other heating elements of the array 102 are being addressed, also preventing crosstalk from inadvertently changing the state of an unaddressed heating element. In examples, each heating element 104 may be pixel sized (e.g., less than 100 μm, about 3-50 μm, about 15-25 μm, at least 21 μm) in an outer layer of a rotatable reimageable latent imaging roll (e.g., imaging member 24, intermediate roller 30) adjacent or as near as reasonable possible to the surface of the latent imaging roll to heat the surface adjacent the heating element. While not being limited to a particular theory, the heating elements 104 may include transistors, such as field effect transistors (FETs) and are shown in the figures by example as thin film transistors (TFTs) 106 (e.g., FETs that may be based on non-crystalline thin-film silicon (a-Si), polycrystalline silicon (poly-Si), or CdSe semiconductor material). In examples the TFTs may be both the heating element 104 switch-devices and the heater for the heating element 104 via current flow in the TFT channel, as will be described in greater detail below.

Heat may be generated by current flow in the TFT 106 and the power developed by the TFT is understood as the product of the source-drain voltage and the current in the channel, which is proportional to the effective carrier mobility. Digital addressing may be accomplished by matrix addressing (e.g., active, passive) the array 102 with orthogonal gate address lines 108 electronically coupled to gate electrodes and with current supply data lines 110 electronically coupled to source electrodes, for example, as shown in FIG. 4. In examples, the gate address lines 108 are orthogonal to the data lines 110 such that a gate/data line pair defines a unique heating element 104. Current may be supplied along the data lines 110 by an external voltage controlled by known digital electronics as understood by a skilled artisan to provide desired heat at the heating element 104 addressed by a specific gate line. This desired heat then heats the adjacent latent imaging roll surface, which may have a layer of fountain solution 32 thereon heated and vaporized by heat transfer from the heating element 104. The heating elements 104 of the array 102 are selectively temporarily switched or controlled to heat the outer surface and fountain solution thereon in a patterned image to an elevated temperature (e.g., about 150° C.-250° C., about 170° C. to 220° C.) that may remain hot for at least about 500 μs to vaporize fountain solution and prevent re-condensation of the vaporized fountain solution at the surface pixel to form a latent image patterned by the heating elements. The heating elements 104 may be as close as possible to the latent imaging roll surface to maximize heat transfer to the fountain solution.

The circuit may require current return lines 112 shown in FIG. 4 as dashed lines electronically coupled to drain electrodes. The current return lines 112 may be low resistance, for example less than 100 ohms as a 2-dimensional mesh 114. While not being limited to a particular theory, the data lines 110 may have a significant resistance 116 which may be taken into account via the current return lines 112. For example, the data line resistance within a pixel may be in the range 1 to 10 ohms so that if the data line extends over 1000 pixels the total data line resistance may be 1 to 10 kohm.

The heat image forming device 100 may also include data line drivers 118 and gate line drivers 120. The gate line drivers 120 (e.g., power amplifiers) may accept a low-power input from a power source and produce a high-current drive input for the gate address lines 108. The data line drivers 118 provide timing signals to switch the heating elements 104 as desired by matrix addressing to provide a transient pixelated heat pattern over the latent imaging roll surface as well understood by a skilled artisan. Data line drivers 118 may be coupled to the current supply data lines 110 on one or both ends of the array.

In examples, the heating array 102 may heat the reimageable outer surface of the rotatable reimageable latent imaging roll to above about 220° C. The outer surface may be a thin (e.g., under 1000 nm, about 200-800 nm, about 450-550 nm) layer (e.g., imaging member blanket) to allow for heat conduction. The thickness of the thin outer surface layer may also depend on the thermal conductivity of latent imaging roll material below the heater array 102. For example, for a specific heat of 2 J/cc, heating by about 200° C. may require heat generation of about 2×10-2 J/cm2. Heating may occur in a line time of about 15 μs and results in a power of about 1.3×103 W/cm2. For a 21 μm pixel, the resulting power is about 6 mW. Of course, heat generation requirements may be less in examples where the outer surface is pre-heated before fountain solution deposition and patterned condensation rejection, as the reimageable outer surface may need to be heated to only about 50° C. The actual power may depend on the details of the heater structure as well as the specific heat and thermal conductivity of the outer surface layer, as well understood by a skilled artisan.

While not being limited by a particular theory, different FET technologies may be used depending on temperature and power requirements of the heating elements 104. Temperature limits (e.g., about 150° C. to 250° C.) for heating may be set in accordance with materials used to fabricate the TFTs 106 and power may be set or adjusted due in part by the TFT mobility, since high mobility corresponds to high current and therefore high power. The maximum source-drain and gate voltages also limit the power that can be developed and depend on the specific TFT, as well understood by a skilled artisan.

Most TFTs operate with gate and source-drain voltages that reach up to about 30V, but can be designed to go higher. In some examples, a source-drain voltage of 20V may be assumed and hence a current of ~300 μA may be needed to develop 6 mW power. The current through a TFT depends on the mobility, the width-to-length ratio W/L, the gate capacitance and the applied voltages. The small pixel size (e.g., under 50 μm, 10-30 μm, about 21 μm) limits the maximum possible W/L and so TFT materials with high mobility are needed to achieve 300 μA current. Required current can be achieved with a W/L<5 which can be designed within a 21 μm pixel using current TFT technology.

Examples of TFT materials include polysilicon (e.g., LTPS), oxide semiconductors (e.g., InGaZnO (IGZO)), and amorphous silicon. LTPS polysilicon may be fabricated by laser recrystallization of a deposited silicon film. Laser recrystallized LTPS has a typical electron mobility of 150-200 cm2/Vs and hole mobility of 50-100 cm2/Vs. LTPS has a temperature limit of about 350° C. and can be fabricated on glass, quartz or polyimide. Lower mobility thin film semiconductor materials such as indium gallium zinc oxide (IGZO) with mobility 40-50 cm2/Vs may also be used. Oxide semiconductors have a general mobility of about 40-50 $cm^2$/Vs and maximum temperature of about 300-400° C. These materials are typically sputtered but may also be deposited from solution and annealed. Amorphous silicon has a general mobility of about 0.5 $cm^2$/Vs and maximum temperature of about 250° C. A-Si is typically deposited by plasma enhanced chemical vapor deposition.

The above materials may be produced on large flexible substrates (e.g., up to about 3 meters by 3 meters, at least 40 inches in width by about the circumference of the latent imaging roll, at least about 13 inches in width by about the circumference of the latent imaging roll) and capable of large area arrays. Matrix addressing is a known technique and the driver electronics are known as well understood by a skilled artisan. These arrays 102 are capable of pixel size down to about 3 μm and are fabricated in large areas up to about 3×3 m. Other TFT materials that are demonstrated but not in volume manufacturing include carbon nanotubes and organic semiconductors. Carbon nanotubes have a general mobility of about 50-80 $cm^2$/Vs and a temperature limit of over 500° C. Organic semiconductors have a general mobility of about 1-5 $cm^2$/Vs and a temperature limit of about 200° C.

The process carried out by the heat image forming device 100 to provide a transient pixelated heat pattern over a surface in an addressable fashion may be sequenced and controlled using one or more controllers 60. The controller 60 may read and execute heat instructions generated by an outboard computer (not depicted) based on a pattern of a material or latent imaging roll surface that is to be heated. For example, the array 102 of heating elements 104 may be selectively operated by matrix addressing as discussed herein based on input from the controllers. While the controller 60 is shown in communication with the heat image forming device 100, it is understood that the controller may be in communication with any component of a system or device associated with the heat image forming device, including the surface to be heated.

Operation and control of the heat image forming device 100 may be performed with the aid of the controller 60, which is implemented with general or specialized programmable processors 82 that execute programmed instructions. The controller is operatively connected to memory (e.g., at least one data store device 84) that stores instruction code containing instructions required to perform the programmed functions. The controller 60 executes program instructions stored in the memory to form heated images on the rotatable reimageable latent imaging roll surface 136 based on a desired printed image. In particular, the controller 60 operates the array 102 of heating elements 104 and the surface to be heated to form the heated image. The memory 64 may include volatile data storage devices such as random access memory (RAM) and non-volatile data storage devices including magnetic and optical disks or solid state storage devices. The processors, their memories, and interface circuitry configure the controllers and/or heating elements 104 to perform the functions described herein. These components may be provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

Figure 5:
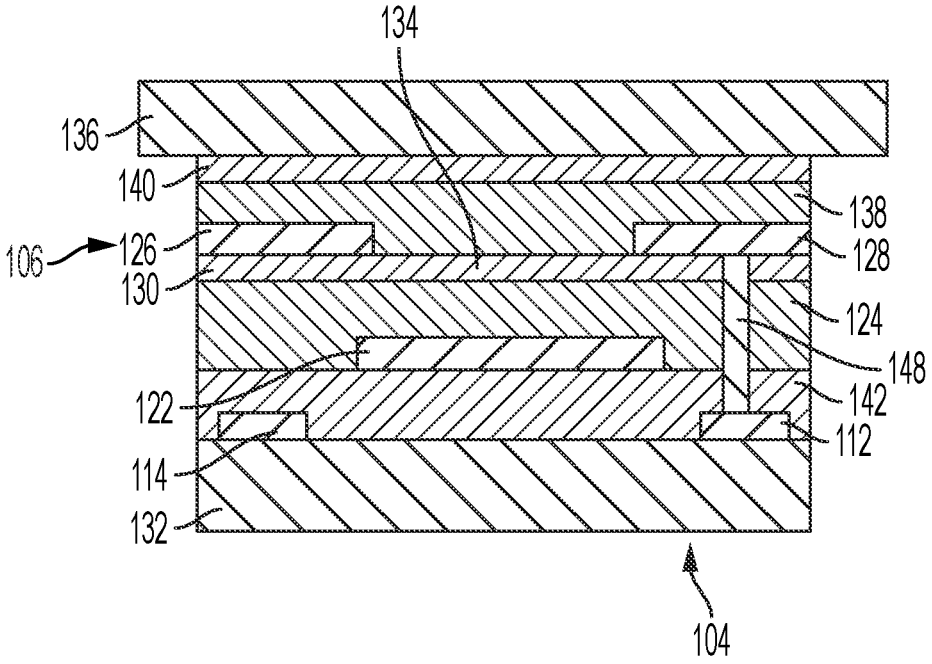
FIG. 5 is a side schematic view partially in cross of a bottom gate heating element in accordance with examples.

FIG. 5 depicts an exemplary schematic illustration of a bottom gate heating element 104 in an order of deposition. The heating element 104 illustrated in FIG. 5 includes a bottom gate TFT 106 with (in general order of deposition) a gate electrode 122, gate dielectric 124, source and drain metal contacts or electrodes 126, 128 (for current supply and return) and semiconductor layer 130, which may be deposited as thin-films onto a support substrate 132. The support substrate 132 is flexible to bend with the array 102 around the latent imaging roll surface 136, provides mechanical support to the heating element 104, and does not interfere with the electrical characteristics of the heating element. The gate electrode 122 is conductive (e.g., metal, chromium, aluminum, silver, gold) and provides signals to the semiconductor 130 which activates the contact between the source and drain electrodes 126, 128. The semiconductor 130 has a current channel 134 defined by a gap between the source electrode 126 and gate electrode 122, and an overlapping distance of the drain and source electrodes in the semiconductor layer. The source and drain electrodes 126, 128 may be formed by two long parallel conductive stripes deposited adjacent the semiconductor 130 and separated by the gap. The electrodes may have a conductive coating, for example, indium tin oxide. The array 102 may be encapsulated in a polymer or ceramic material.

The heating element 104 shown in the figures is an electronic switch heater, having the current between source electrode 126 and drain electrode 128 controlled (or modulated) by the voltage applied to the gate electrode 122, which is separated from the drain and source electrodes by the highly insulating gate dielectric layer 124. The current flows in the plane of the semiconductor 130, perpendicularly to the applied gate voltage. Bottom gate heating elements 104 are not limited to this configuration, as for example, the source-drain electrodes 126, 128 may be underneath the semiconductor 130 rather than on top.

Heat may be developed in the current channel 134, which is near the top surface of the heating element 104 and adjacent a latent imaging roll surface 136 to be heated. In fact, in specific examples the current channel 134 may be closer to the latent imaging roll surface 136 than the current return lines 112, the data lines 110 and the gate lines 108. A passivation layer 138 may be deposited above the semiconductor layer 130 and on top of the current channel 134 as an insulator (e.g., silicon oxide) to protect the source-drain contacts and the current channel. The current channel 134 may be less than about 200 nm or only about 10-100 nm thick. A subsurface layer 140 may be added and provide a specific contact material to the latent imaging roll surface 136 being heated. In examples, the subsurface layer 140 may be a patterned pad made of a high thermal conductivity material (e.g., a metal) to ensure a uniform temperature across the heating element 104 pixel. The passivation layer 138 and the subsurface layer 140 may be very thin (e.g., less than 250 nm, less than 150 nm, about 15-150 nm thick) so that the current channel heat source is very close to the latent imaging roll surface 136 being heated.

Still referring to FIG. 5, the heating element 104 includes current return metal mesh 114 conductively coupled to the drain contact 128 via metalized vias 148 therebetween, and separated from the gate electrode 122 by a dielectric layer 142, which in examples may be part of the gate dielectric 124. The dielectric 124, 142 prevents electrical shorting between the semiconductor 130, gate electrode 122 and metal mesh 114. The current return lines 112 of metal mesh 114 are not part of a typical TFT design since it is not needed or considered for other TFT array uses (e.g., liquid crystal display). The current return mesh 114 may be a separate layer positioned underneath the gate electrode 122, rather than on top of the current channel 134 so that the current channel is as close as reasonable to the latent imaging roll surface 136 to provide a most effective and efficient heater array 102.

The example depicted in FIG. 5 may be used with an oxide semiconductor or amorphous silicon, both of which are typically made as bottom gate TFTs. Other semiconductor materials are feasible as understood by a skilled artisan. The TFT structure may be conventionally made by photolithographic patterning but could also be made by other approaches, such as by direct additive printing techniques, provided the pixel size is consistent with printing technology.

Polysilicon may be used in a heater array because of its high mobility and hence high heating power. However, the LTPS array is fabricated as a top gate TFT largely because the process starts with the laser crystallization of a thin silicon film on a substrate to form the channel. In the top gate geometry, the heat source which is the TFT channel is necessarily separated from the top surface by a significant thickness of material because of the presence of the gate dielectric, the source-drain contacts and the mesh metal return. This combination of layers might be 2 or more microns thick. The thickness might be suitable for some applications but a thinner separation between the TFT channel heater element and the surface may be desirable for applications requiring faster or more efficient heating.

Figure 6:
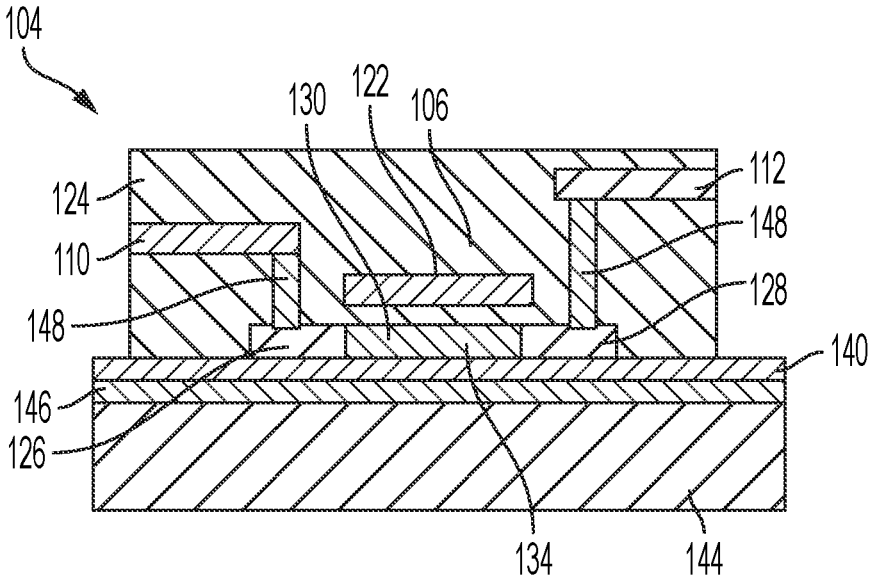
FIG. 6 is a side schematic view partially in cross of a top gate heating element in accordance with examples.
Figure 7:
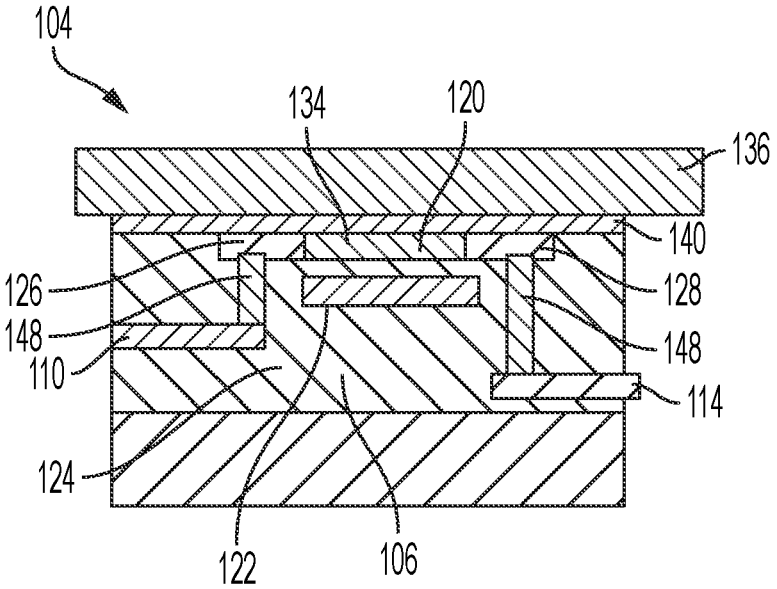
FIG. 7 is a side schematic view partially in cross of an inverted top gate heating element in accordance with examples.

FIG. 6 depicts an exemplary schematic illustration of a top gate heating element 104 in an order of fabrication. The heating element 104 includes a top gate TFT 106 with a thin subsurface layer 140 mounted on a carrier substrate 144. The carrier substrate 144 is a base on which the electronic heating elements are fabricated, and may be a flexible substrate made, for example, out of glass a few micron thick, metals and/or polymers such as polyethyleneteraphalate. The TFT 106 is shown in top gate configuration on the subsurface layer 140 including the semiconductor layer 130, source and drain electrodes 126, 128, gate dielectric 124, and gate electrode 122, with the gate dielectric surrounding the gate electrode and separating the gate electrode from the current return mesh 114. FIG. 7 depicts an exemplary schematic of the top gate TFT 106 shown in FIG. 6 released from the carrier substrate 144 and inverted onto flexible support substrate 132 to form the heating element 104. According to examples, the heat source current channel 134 may be designed closer to the latent imaging roll surface 136 by depositing the TFT 106 on the carrier 144 for the fabrication of the top gate heating element 104 and then removing the TFT from the carrier and onto the flexible support substrate 132 for attachment to the rotatable reimageable latent imaging roll as an outer layer thereof.

As can be seen in FIG. 6, between the carrier substrate 144 and the current channel 134 may be one or more layers 146 to help affect release. The release layer(s) 146 may include a deposited insulator, spin on material, or combinations of the two on the carrier substrate. In examples, the release layer 146 may be polyimide and the subsurface layer 140 may be a deposited silicon oxide. The release layer 146 may be delaminated from the carrier substrate 144 by a known process such as laser lift off. If necessary, the release layer 146 may be removed, for example by etching, leaving only a thin oxide on top of the semiconductor current channel 134 and next to the latent imaging roll surface 136.

As noted above regarding the structure of the exemplary inverted top heating element 104 depicted in FIG. 7, the TFT 106 includes doped source and drain contacts 126, 128 and gate electrode 122. The source electrode 126 may be coupled to the data line 110 by metalized vias 148. Similarly, the drain electrode 128 may be coupled to the current return mesh 114 by metalized vias 148, and the gate electrode 122 is coupled to a gate line 108 (FIG. 4). The metal current return mesh 114 may be a separate metal layer. The support substrate 132 may be laminated onto the TFT before or after the delamination to give robustness after release from the carrier substrate 144. The support substrate 132 may be flexible or rigid as long as it allows attachment as an outer layer of the rotatable reimageable latent imaging roll, as understood by a skilled artisan. As in the example depicted in FIG. 5, a subsurface layer 140 may be added between the TFT 106 and the latent imaging roll surface 136 for insulation and/or to provide uniform heating.

It is understood that the heating element TFTs 106 can be constructed in diverse ways, with a difference among these structures being the position of the electrodes 122, 126, 128 relative to the active semiconductor 130. For example, the top gate TFT depicted in FIGS. 6 and 6 has the semiconductor 130 coplanar with the source and drain electrodes. In a top gate, bottom-contact configuration the gate electrode 122 is on top of the gate dielectric layer 124, and the source and drain electrodes 126, 128 are lower layers underneath the semiconductor 130 and just above the subsurface layer 140. In this structure, the source and drain electrodes 126, 128 can also be deposited by lift-off photolithography or shadow mask thermal evaporation directly onto the subsurface layer 140. Top gate, top-contact TFT 106 configuration is similar to TGBC configuration with a difference that the source and drain electrodes 126, 128 are deposited onto the semiconductor 130. Bottom gate configurations, such as depicted in FIG. 5, have three common stages (support substrate 132, gate electrode 122 and gate dielectric 124) with additional stages above the substrate and below the gate electrode for the dielectric layer 142 and the current return line 112 or mesh 114 deposition. Of course, in the bottom gate configurations, the semiconductor 130 may be coplanar and/or either above or below the source and drain electrodes 126, 128.

Figure 8:
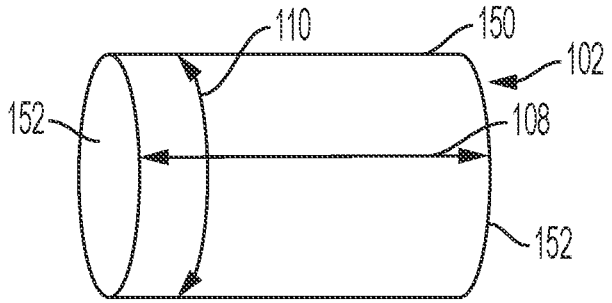
FIG. 8 is an exemplary heat image forming roller.
Figure 9:
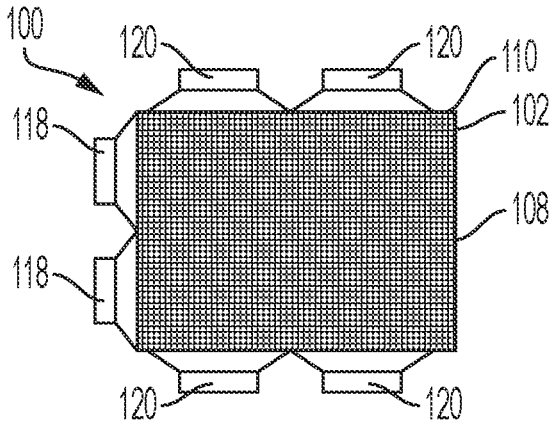
FIG. 9 is an exemplar heat image forming device disposable as an outer layer of the heat image forming roller of FIG. 8.

FIGS. 8 and 9 illustrate how an exemplary array 102 may be configured on the rotatable reimageable latent imaging roll, which in examples may be the imaging member 24, intermediate roller 30, additional transfer roller or some combination thereof. The latent imaging roll may be configured as a drum 150 surrounded by the heater array 102 and an outer surface thin layer (e.g., blanket, elastomeric, silicone, polymer, polyimide). FIG. 8 illustrates a drum 150 with gate address lines 108 and current supply data lines 110 of the array 102 oriented about the drum, with the gate lines extending adjacent or at the circumferential surface of the latent imaging roll and the gate lines extending longitudinally across the length of the imaging roll surface to its opposite ends 152. The array 102 in FIG. 9 is shown with gate line drivers 118 and data line drivers 120 at the periphery of the array, with the drivers typically silicon integrated circuits on a flex carrier but could be made with TFT technology.

As discussed herein by examples, the heater array 102 heats the outer surface of the reimageable latent imaging roll to form a latent image of a fluid (e.g., fountain solution) by patterned fluid evaporation or condensation rejection. Selective patterned heating by the heating elements 104 may leave the heated pixels at an elevated temperature longer than desired for subsequent latent imaging. In examples the latent imaging roll may be cooled internally (e.g., with chilled fluid) or externally downstream latent image/ink image transfer (e.g., via a blanket chiller roll to a temperature (e.g., under about 50° C.)). This cooling may remove image-wise residual heat from the latent imaging roll surface for subsequent patterned imaging with improved image quality by bringing the outer surface temperature to an even temperature across the array that is below condensation rejection or evaporation temperatures.

The heater current is transmitted along the data lines 110 to respective heater elements 104. The data lines 110 may extend over the circumference of the latent imaging roll (FIG. 8). In addition, the data lines must be smaller (e.g., less than 20 μm wide, less than 10 μm wide, about 5 μm wide) than the pixel size and at least about 20-40 cm long for a typical roller design. For a large heater array 102 with many field effect transistor pixels, the data lines 110 may be long and narrow (e.g., less than a third the pixel width by over 1000 pixels long, about 2-10 and extending over 1000 pixels).

Thin film array fabrication may limit the metal thickness of the data lines 110 such that the smallest line resistance may be about 0.1 ohm/sq. An effect of these conditions may be to introduce a significant voltage drop (e.g., about 25%, more than about 20%) along the data line so that heater elements 104 distal to the voltage source will pass a lower current than heater elements proximal to the voltage source, such that heating may be non-uniform across the length of the array 102. To prevent significant non-uniform heating, the voltage drop along the data line should be minimal, for example, less than about 5% or no more than about 1V out of an applied 20V supply. There are various ways that can be used individually or in combination to solve this problem of excessive voltage drop. For example, connecting data line drivers 118 to opposite ends of the data lines 110 reduces voltage drop. In addition, a large voltage drop (e.g., about 5V out of a 20V supply) may be compensated by the controller 60 controlling the data drivers 118 to increase the applied voltage at the locations where voltage drop is larger. Another exemplary approach is to vary the heating element 104 or TFT 106 design, for example the width-to-length ratio W/L, across the array 102 so that a lower voltage in the center of the array produces the same power and heat from center heating elements as edge heating elements receiving a higher voltage at the edge of the array.

The current return lines 112 also have a resistive voltage drop. However, the current return mesh 114 minimizes resistance when formed as a 2-dimensional metal grid as shown by example in FIG. 4. The mesh 114 resistance is negligible (e.g., less than 5% of the data line resistance) compared to the data line 110 resistance, as understood by a skilled artisan.

Still referring to FIGS. 8 and 9, the heater array 102 may wrap around the drum 150 with no gap at the join so that a latent image can be formed irrespective of its position on the drum. The heater array 102 requires driver circuits (e.g., silicon ICs) to address the TFT gates on one side of the array and the data lines on the two orthogonal sides. The gate address lines may be oriented across the web and the data lines in the direction of the web. Because of the high current requirement, the data lines may be addressed from both ends, as discussed above and illustrated in FIG. 9.

Figure 10:
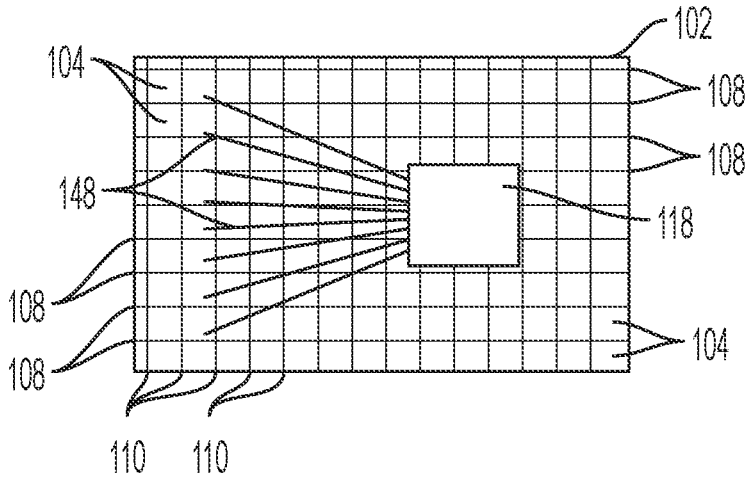
FIG. 10 is a diagram showing exemplary data drivers with a heat image forming array.

While the data drivers 118 and gate drivers 120 are shown in FIG. 9 as at the sides of the array 102, it is understood that when wrapped around the drum 150, the drivers may be positioned differently based on physical and spatial limitations of the latent imaging roll. FIG. 10 illustrates an exemplary configuration with data drivers 118 mounted on top of the array 102 instead of their traditional positions off the end of the array. The data drivers 118 may be silicon ICs on a flex carrier as a known approach of addressing. One or more data drivers 118 may be positioned anywhere along the data lines 110. For example, two data drivers 118 may be each positioned about 25% of the distance from the ends of the array to minimize voltage drop across the low resistance data lines 110. Data drivers may be attached to the array 102, for example, by coating the array with an insulator layer, such as polyimide, opening vias 148 to the data lines 110, metalizing the vias and bonding the flex carrier to the metallization, for example with anisotropic conductive tape. The array may then be inverted so that the substrate is oriented towards the surface of the blanket and the heating elements 104 are embedded in the blanket. In addition, the data drivers are also embedded in the blanket. The structure is described in more detail below.

Figure 11:
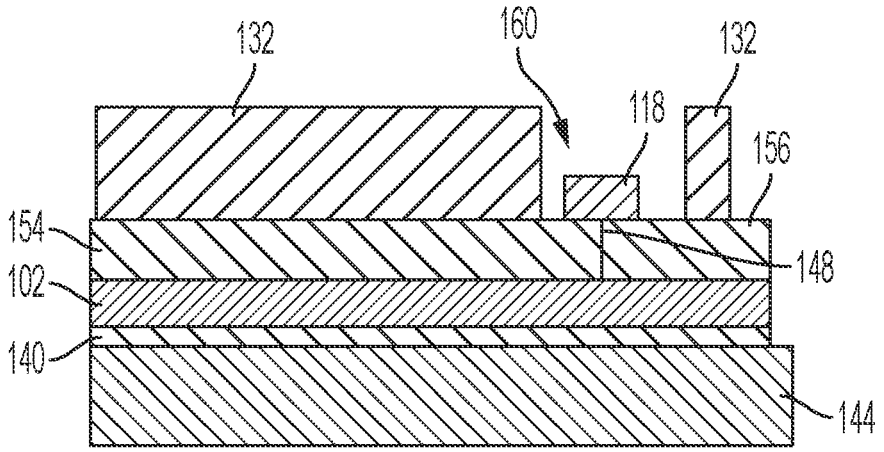
FIG. 11 is a schematic illustrating an exemplary heat image forming device fabrication.

FIG. 11 is a schematic illustrating an exemplary heat image forming device 100 fabrication, including a carrier substrate 144 (e.g., glass), a flexible subsurface layer 140 (e.g., polyimide insulator layer), a heating array 102, an overcoat layer 154 (e.g., polyimide insulator layer), data drivers 118 mounted on the overcoat layer, and a support substrate 132. The carrier substrate may be coated with the thin subsurface layer 140, here less than about 20 μm, or less than about 10 μm, or less than about 5 μm. This subsurface layer 140 may ultimately be the layer of the heat image forming device 100 closest to the blanket surface and may provide some protection for the heater array 102 which may be applied above the subsurface layer. A buffer layer (not shown), such as silicon oxide, may also be deposited on the subsurface layer 140 to provide a surface for array 102 of heating elements 104.

The array 102 may be over-coated with a thicker insulating overcoat layer 154 (e.g., 10-20 μm polyimide layer), which may make the array more robust. The overcoat layer 154 may also form a substrate for the data drivers 118. Vias 148 may be opened from the data drivers 118 to the data lines 110 and metal traces from the data drivers may be deposited at selected locations along the data lines, as understood by a skilled artisan. The data drivers 118 may be attached at this time or after the support substrate 132 is attached to the overcoat layer 154.

A thicker (e.g., greater than 20 μm, greater than 50 μm, greater than about 100 μm) flexible support substrate 132 with cut-outs 160 for the data drivers 118 may be bonded to the heater array 102 via the overcoat layer 154, for example by lamination or alternate approaches understood by a skilled artisan. A small region 156 (e.g., 1-20 mm, 1-5 mm) may be left without the support substrate 132 at one or both ends of the coated array for bonding the two ends together. The ends of the data lines 110 that may overlap may be cut precisely at the end of a heating element 104 pixel in preparation for bonding. The gate drivers 120 may be bonded to the array 102, for example at an end of the drum 150, by vias from the support substrate 132 or to the overcoat layer 154 cut-outs in the support substrate.

Figure 12:
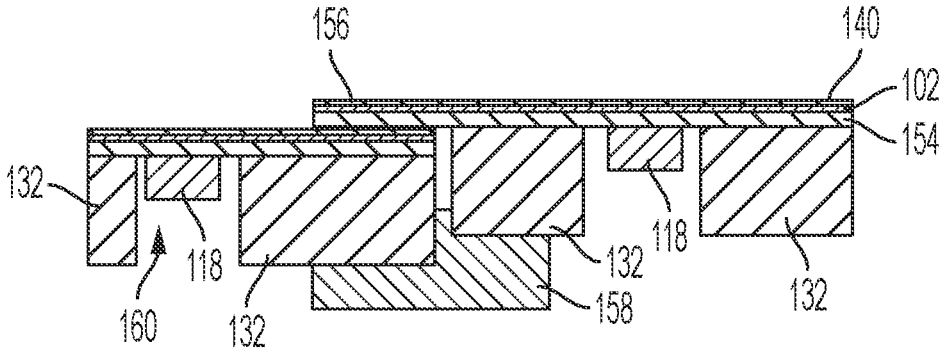
FIG. 12 is a schematic illustrating the exemplary heat image forming device of FIG. 11 with its bonding region attached to an opposite end of a coated heater array.

FIG. 12 is a schematic illustrating the exemplary heat image forming device 100 of FIG. 11 with its bonding region 156 attached to an opposite end of the coated heater array 102 to form a seamless bond (e.g., ends bonded leaving no gap greater than a pixel width). The structure of FIG. 11 may be released from the glass carrier for example by laser lift-off. In examples, the small regions of data lines at the edges of the array are bonded to each other to form the blanket cylinder with precisely aligned pixels at the join. As can be seen in FIG. 12, the small region 156 without support substrate is aligned and bonded over an opposite end of the coated array. A strengthener 158 (e.g., adhesive, bonding agent) may be added at the back of the join to make the bond stronger. Any height difference caused by the overlapped bond is small (e.g., less than about 20 μm, about 10 μm) enough to not affect performance of the blanket/surface layer. An alternative approach is that the two ends of the array could be abutted.

The flexible and now cylindrical heater array 102 may be integrated with the support drum 150 and electronic connections to the gate and data drivers are made in the interior of the cylinder as understood by a skilled artisan. An additional thin surface coating (e.g., blanket, surface layer, silicone plate) may be applied to prevent wear of the heaters and/or to give the blanket surface properties needed for the fountain solution. The gate drivers 120 may extend beyond the longitudinal ends 152 (FIG. 8) of the cylinder and can be folded down away from the surface. Interconnects from the data and gate drivers 118, 120 may be routed to the interior of the drum 150 (FIG. 8), for example to a printed circuit board (not shown) with necessary electronics to operate the drivers. The transfer of data and power to the drum 150 may also be accomplished via optical transfer along the axis of the drum.

Figure 13:
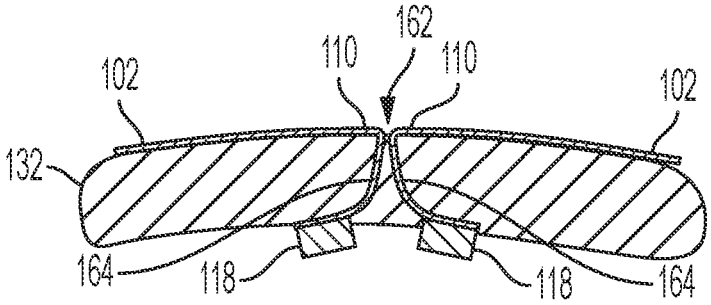
FIG. 13 is a side view, partially in section, of an exemplary heat image forming device on a support substrate.
Figure 14:
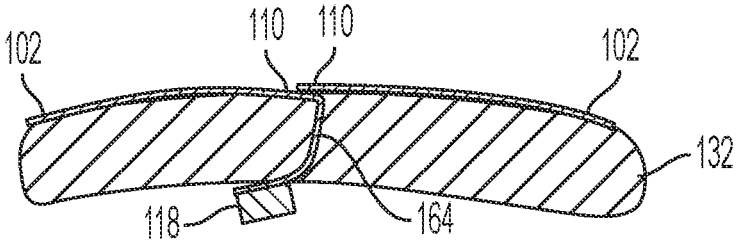
FIG. 14 is a side view, partially in section, of another exemplary heat image forming device on a support substrate.
Figure 15:
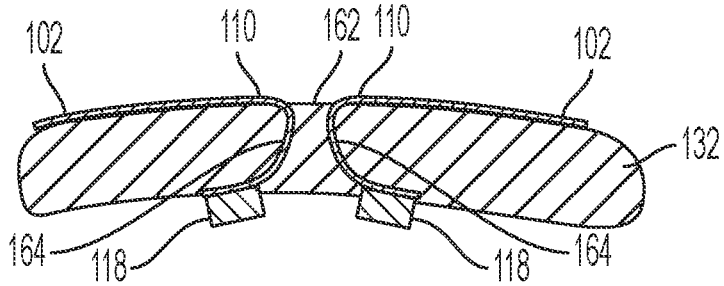
FIG. 15 is a side view, partially in section, of yet another exemplary heat image forming device on a support substrate.

FIGS. 13-15 are side views, partially in section, showing examples of heat image forming devices 100 on a support substrate 132. In the schematic illustration of FIG. 13, a heater array 102 has data lines 110 at opposite ends of the array joining to form a seamless blanket heater. In particular, any seam 162, defined as a gap between the joining array ends is smaller than a heating element 104 pixel (e.g., about 21 μm). The heating elements 104 are on top of the support substrate 132 and the data drivers 118 are shown mounted under the support substrate 132 within the latent imaging roll. The data drivers 118 may be conductively coupled to the data lines 110 by, for example, metal lines 164 through vias in the support substrate 132. As another approach, the heater array 102 may be bent with a radius (e.g., about 10 μm) less than half a pixel size as a foldable array 102 with a sharp bend at the join.

FIG. 14 illustrates a heat image forming device 100 on a support substrate 132 with a data driver 118 at one end of the heater array 102, and with a free opposite end bonded to the data driver coupled end with heating element 104 pixels accurately aligned. Similar to the overlapping join illustrated in FIG. 12, a small height difference caused by the overlapped bond (e.g., less than about 20 μm, about 10 μm) does not affect performance of the blanket/surface layer.

Figure 16:
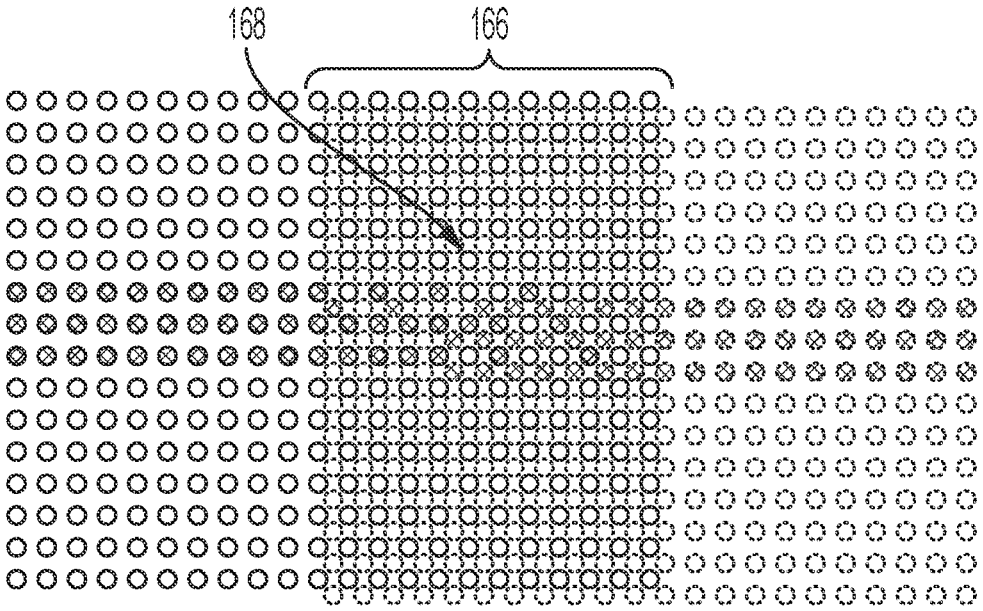
FIG. 16 is a diagram showing an exemplary latent imaging with an overlapping area from transfer of latent images from two latent imaging rolls.

FIG. 15 illustrates an exemplary heat image forming device 100 on a support substrate 132 with the heater array 102 data lines 110 at opposite ends of the array separated by a gap about or greater than the size of a heating element pixel to form a seamed blanket heater. This may occur, for example, with a heater array 102 having a larger radius of curvature. When bent inwards at the seam to hide the data drivers 118, the heater array does not bend sharply, leaving an inactive seam between opposite ends of data lines 110. The heater array 102 in this example may not sufficiently heat the latent imaging roll surface at the seam, and thus fountain solution across the seam may not evaporate and will remain on the latent imaging roll to prevent inking. If the circumference of the latent imaging roll outer surface is commensurate with a printed page size, then the printing region of the blanket may be selected so as to not use the seam region. As another approach, if the seam is difficult to be made small enough to totally eliminate the gap, may be to design an overlapping, digitally addressable region. This may be achieved for an intermediate roller 30 as a latent imaging roll smaller than the imaging member 24 (e.g., the imaging member 24 diameter may be several times the intermediate roller diameter) and two passes per print. Yet another approach would include a second latent imaging roll (e.g., intermediate roller 30) adjacent the first latent imaging roll with the two rolls having their seam out of phase. The second latent imaging roll may be configured like the first latent imaging roll, with a heat image forming device 100 as described with reference to the (first) latent imaging roll. It should be noted that there may be no need to precisely align the two passes or two rollers as long as an overlapping area is big enough to be digitally tuned to transition the two heater arrays 102 slowly to minimize visual impact in the overlapping area, as shown for example in FIG. 16. As can be seen in FIG. 16, an overlap 166 may have double resolution (e.g., dots per inch), with both heater arrays 102 digitally tuned such that a transition 168 across the overlap is not recognizable from other heat image areas, and may appear merely as local imperceptible noise.

FIG. 17 illustrates a block diagram of the controller 60 for executing instructions to automatically control the digital image forming device 10, heat image forming device 100, and components thereof. The exemplary controller 60 may provide input to or be a component of the digital image forming device for executing the image formation method including forming a latent image of fountain solution in a system such as that depicted in FIGS. 2-15 and described in greater detail below.

The exemplary controller 60 may include an operating interface 80 by which a user may communicate with the exemplary control system. The operating interface 80 may be a locally-accessible user interface associated with the digital image forming device 10. The operating interface 80 may be configured as one or more conventional mechanism common to controllers and/or computing devices that may permit a user to input information to the exemplary controller 60. The operating interface 80 may include, for example, a conventional keyboard, a touchscreen with "soft" buttons or with various components for use with a compatible stylus, a microphone by which a user may provide oral commands to the exemplary controller 60 to be "translated" by a voice recognition program, or other like device by which a user may communicate specific operating instructions to the exemplary controller. The operating interface 80 may be a part or a function of a graphical user interface (GUI) mounted on, integral to, or associated with, the digital image forming device 10 with which the exemplary controller 60 is associated.

The exemplary controller 60 may include one or more local processors 82 for individually operating the exemplary controller 60 and for carrying into effect control and operating functions for image formation onto a print substrate 34, including rendering digital latent images and ink images therefrom. For example, in real-time during the printing of a print job, processors 82 may adjust image forming (e.g., heat imaging, fountain solution deposition, ink application and transfer) with the digital image forming device 10 with which the exemplary controller may be associated. Processor(s) 82 may include at least one conventional processor or microprocessor that interprets and executes instructions to direct specific functioning of the exemplary controller 60, and control adjustments of the image forming process with the exemplary controller.

The exemplary controller 60 may include one or more data storage devices 84. Such data storage device(s) 84 may be used to store data or operating programs to be used by the exemplary controller 60, and specifically the processor(s) 82. Data storage device(s) 84 may be used to store information regarding, for example, digital image information, heating element addressing, and fountain solution deposition information with which the digital image forming device 10 is associated.

The data storage device(s) 84 may include a random access memory (RAM) or another type of dynamic storage device that is capable of storing updatable database information, and for separately storing instructions for execution of digital addressing operations by, for example, processor(s) 82. Data storage device(s) 84 may also include a read-only memory (ROM), which may include a conventional ROM device or another type of static storage device that stores static information and instructions for processor(s) 82. Further, the data storage device(s) 84 may be integral to the exemplary controller 60, or may be provided external to, and in wired or wireless communication with, the exemplary controller 60, including as cloud-based data storage components.

The data storage device(s) 84 may include non-transitory machine-readable storage medium used to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 60 and that causes the digital image forming device 10 to perform any one or more of the methodologies of the present invention. The term "machine-readable storage medium" shall accordingly be taken to include, but not be limited to, solid-state memories, and optical and magnetic media.

The exemplary controller 60 may include at least one data output/display device 86, which may be configured as one or more conventional mechanisms that output information to a user, including, but not limited to, a display screen on a GUI of the digital image forming device 10 or associated image forming device with which the exemplary controller 60 may be associated. The data output/display device 86 may be used to indicate to a user a status of the digital image forming device 10 with which the exemplary controller 60 may be associated including an operation of one or more individually controlled components at one or more of a plurality of separate image processing stations or subsystems associated with the image forming device.

The exemplary controller 60 may include one or more separate external communication interfaces 88 by which the exemplary controller 60 may communicate with components that may be external to the exemplary control system. At least one of the external communication interfaces 88 may be configured as an input port to support connecting an external CAD/CAM device storing modeling information for execution of the control functions in the image formation and transfer operations. Any suitable data connection to provide wired or wireless communication between the exemplary controller 60 and external and/or associated components is contemplated to be encompassed by the depicted external communication interface 88.

The exemplary controller 60 may include an image forming control device 90 that may be used to control fountain solution deposition, digital addressing, heat imaging, and latent imaging to render images on imaging member surface 26 for transfer to a print substrate. The image forming control device 90 may operate as a part or a function of the processor 82 coupled to one or more of the data storage devices 84 and the digital image forming device 10 (e.g., heat image forming device 100, inking apparatus 18, dampening fluid station 12), or may operate as a separate standalone component module or circuit in the exemplary controller 60.

All of the various components of the exemplary controller 60, as depicted in FIG. 17, may be connected internally, and to the digital image forming device 10, associated image forming apparatuses associated with the heat image forming device 100 and/or components thereof, by one or more data/control busses 92. These data/control busses 92 may provide wired or wireless communication between the various components of the image forming device 10 and any associated image forming apparatus, whether all of those components are housed integrally in, or are otherwise external and connected to image forming devices with which the exemplary controller 60 may be associated.

It should be appreciated that, although depicted in FIG. 17 as an integral unit, the various disclosed elements of the exemplary controller 60 may be arranged in any combination of subsystems as individual components or combinations of components, integral to a single unit, or external to, and in wired or wireless communication with the single unit of the exemplary controller. In other words, no specific configuration as an integral unit or as a support unit is to be implied by the depiction in FIG. 17. Further, although depicted as individual units for ease of understanding of the details provided in this disclosure regarding the exemplary controller 60, it should be understood that the described functions of any of the individually-depicted components, and particularly each of the depicted control devices, may be undertaken, for example, by one or more processors 82 connected to, and in communication with, one or more data storage device(s) 84.

Figure 18:
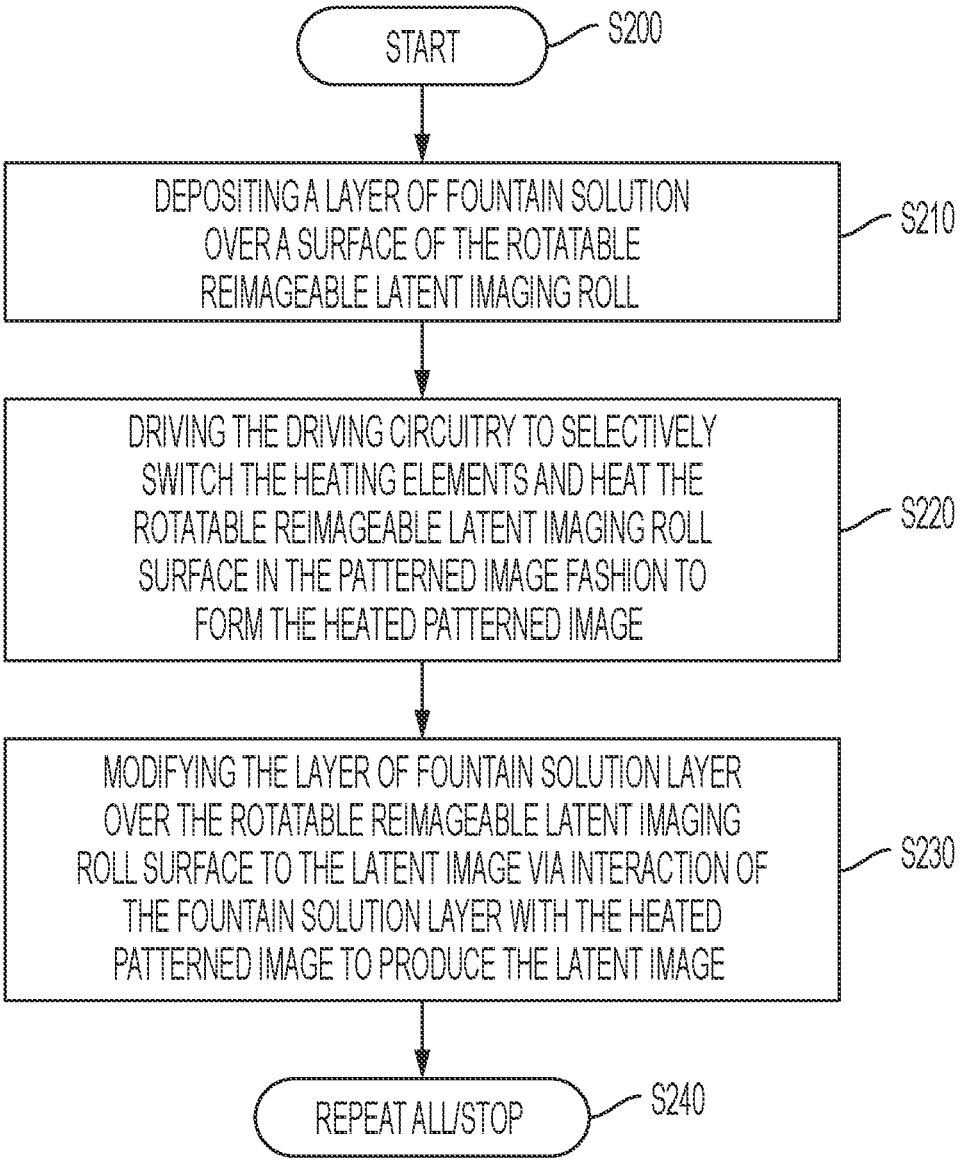
FIG. 18 is a flowchart depicting a latent image forming operation of an exemplary image forming device.

The disclosed embodiments may include an exemplary method for forming a latent image of fountain solution on a rotatable reimageable latent imaging roll of a digital image forming device using a heat image forming device. FIG. 18 illustrates a flowchart of such an exemplary method. As shown in FIG. 18, operation of the method commences at Step S200 and proceeds to Step S210.

At Step S210, a fountain solution applicator deposits a layer of fountain solution over a surface of the rotatable reimageable latent imaging roll. The fountain solution may be deposited as a vapor or aerosol that condenses on the surface of the latent imaging roll. The layer of fountain solution may also be deposited as a fluid layer onto the latent imaging roll surface. The Operation of the method proceeds to Step S220, where the controller directs the driving circuitry communicatively connected to the heating array to selectively control the heating elements and heat the rotatable reimageable latent imaging roll surface in a patterned image to form the heated patterned image thereon.

Next, at Step S230, the heating array modifies the layer of fountain solution layer over the rotatable reimageable latent imaging roll surface to the latent image via interaction of the fountain solution layer with the heated patterned image to produce the latent image of fountain solution on the rotatable reimageable latent imaging roll. In examples, the heating array heats and vaporizes the fountain solution on pixels of the latent imaging roll surface, with the evaporated fountain solution detached from the latent imaging roll surface. In examples, the heating array heats the surface of the latent imaging roll and inhibits condensation of fountain solution vapor on the heated pixel surface. Operation may cease at Step S240, or may continue by repeating back to Step S20 for a subsequent fountain solution deposition.

The exemplary depicted sequence of executable method steps represents examples of a corresponding sequence of acts for implementing the functions described in the respective steps. The exemplary depicted steps may be executed in any reasonable order to carry into effect the benefits of the disclosed approaches. No particular order to the disclosed steps of the methods is necessarily implied by the depiction in FIGS. 2, 3 and 18, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. In addition, while examples discuss a heating array disposed as a layer of a rotatable reimageable latent imaging roll proximate an outer surface of the latent imaging roll to create a latent image of fountain solution, it is understood that examples include a heating array that may be disposed as a layer of a reimageable imaging roll that creates an image of marking material or some other fluid. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A heat image forming device useful in printing with an image forming device having a rotatable reimageable latent imaging roll, comprising:

a heating array disposed as a layer of the rotatable reimageable latent imaging roll proximate an outer surface of the latent imaging roll, the heating array including a pixelated array of controllable heating elements spread about the layer with each heating element corresponding to a respective pixel of the pixelated array, wherein a fluid is deposited over the rotatable reimageable latent imaging roll;

driving circuitry communicatively connected to the heating array for selectively temporarily heating the heating elements in a patterned image to an elevated temperature;

the selectively temporarily heated heating elements configured to heat portions of the rotatable reimageable latent imaging roll outer surface proximate the heating array as a heated patterned image when the selected heating elements are at the elevated temperature, the heated patterned image configured to modify the deposited fluid over the rotatable reimageable latent imaging roll to produce a latent image of fluid on the rotatable reimageable latent imaging roll surface based on the patterned image.

2. The device of claim 1, each controllable heating element including a thin film transistor, the thin film transistors each having a semiconductor layer, a gate electrode, a source electrode, a drain electrode and a gate dielectric layer, the semiconductor layer having a current channel defined by a spatial gap between the source electrode and gate electrode, and an overlapping distance of the drain and source electrodes in the semiconductor layer.

3. The device of claim 2, the driving circuitry including a plurality of conductive lines including gate address lines, current supply data lines, and current return lines, with each one of the gate electrodes electronically coupled to one of the gate lines, each one of the source or drain electrodes electronically connected to one of the data lines, and each of the other one of the source or drain electrodes electronically connected to one of the current return lines, each heating circuit having a current supplied via a connecting current supply data line in the current channel that is controlled by a voltage applied to the gate electrode via a connecting gate address line.

4. The device of claim 3, wherein the current return lines form a current return mesh layer offset from the gate electrode by the second dielectric layer and opposite the source and drain electrodes, with different ones of the current return lines running parallel to both the gate address lines and the current supply lines, and the current channel is closer to the outer surface than the current return mesh layer.

5. The device of claim 3, further comprising gate line drivers coupled to the gate address lines and data line drivers coupled to the current supply data lines, the gate address lines being orthogonal to the current supply data lines, with adjacent pairs of gate address lines and data lines defining a respective one of the heating elements, and the controllable heating elements being selectively switched via active matrix addressing.

6. The device of claim 5, wherein the gate line drivers and data line drivers are positioned on a side of the pixelated array of controllable heating elements opposite the outer surface of the rotatable reimageable latent imaging roll, with the gate line drivers and data line drivers spatially separated from the pixelated array of controllable heating elements by a dielectric layer therebetween.

7. The device of claim 3, wherein the rotatable reimageable latent imaging roll has a longitudinal axis and a cylinder circumference, the gate address lines extend across the latent imaging roll parallel to the longitudinal axis and the current supply data lines extend along the cylinder circumference.

8. The device of claim 1, the heating array further including an insulating layer over the pixelated array of controllable heating elements adjacent the outer surface of the rotatable reimageable latent imaging roll.

9. The device of claim 8, wherein the rotatable reimageable latent imaging roll is further configured to receive an ink image thereon for transfer of said ink image to a print substrate based on the heated patterned image.

10. The device of claim 1, wherein the rotatable reimageable latent imaging roll has a cylinder circumference, each heating element being pixel sized with a width and a length, the heating array having the heating elements extending from a first side of the heating array along the cylinder circumference to a second side of the heating array opposite the first side leaving a gap between the first side and the second side smaller than the width or length of a heating element resulting in a seamless heating array around the rotatable reimageable latent imaging roll.

11. The device of claim 1, wherein the rotatable reimageable latent imaging roll has a cylinder circumference, each heating element being pixel sized with a width and a length, the heating array having the heating elements extending from a first side of the heating array along the cylinder circumference to a second side of the heating array opposite the first side and in contact with the first side when disposed as the layer of the rotatable reimageable latent imaging roll.

12. The device of claim 1, wherein the rotatable reimageable latent imaging roll is a first rotatable reimageable latent imaging roll having a cylinder circumference, each heating element being pixel sized with a width and a length, the heating array having the heating elements extending from a first side of the heating array along the cylinder circumference to a second side of the heating array opposite the first side leaving a gap between the first side and the second side larger than the width or length of a heating element, and further comprising a second rotatable reimageable latent imaging roll having a second heating array disposed as an outer layer thereof proximate an outer surface of the second rotatable reimageable latent imaging roll, the second heating array including a second pixelated array of second controllable heating elements spread about the outer layer with each heating element corresponding to a respective second pixel of the second pixelated array; the second rotatable reimageable latent imaging roll further having second driving circuitry communicatively connected to the second heating array for selectively temporarily heating the second heating elements in image-wise fashion to the elevated temperature, wherein portions of the second rotatable reimageable imaging member outer surface proximate the second heating array are heated by the second heating elements when the selected second heating elements are at the elevated temperature, the second rotatable reimageable latent imaging roll located adjacent the first rotatable reimageable latent imaging roll and operable in combination with the first rotatable reimageable latent imaging roll to create a seamless heated image output onto a substrate in contact with both the first rotatable reimageable latent imaging roll and the second rotatable reimageable latent imaging roll.

13. The device of claim 1, further comprising a fountain solution applicator configured to deposit fountain solution as the fluid over a surface of the rotatable reimageable latent imaging roll, and the latent image is formed by the fountain solution remaining over unheated heating elements of the heating array.

14. The device of claim 1, wherein the rotatable reimageable latent imaging roll is an intermediate roller in rolling contact with an imaging member to transfer the latent image of fluid to the imaging member.

15. A method of forming a latent image of fluid on a rotatable reimageable latent imaging roll of a digital image forming device using the heat image forming device of claim 1, comprising:

a) depositing a fluid over a surface of the rotatable reimageable latent imaging roll;

b) driving the driving circuitry to selectively control the heating elements and heat the rotatable reimageable latent imaging roll surface in the patterned image to form the heated patterned image; and c) modifying the deposited fluid layer over the rotatable reimageable latent imaging roll surface to the latent image via interaction of the deposited fluid with the heated patterned image to produce the latent image of fluid on the rotatable reimageable latent imaging roll.

16. The method of claim 15, further comprising applying ink over the rotatable reimageable latent imaging roll surface to produce an inked image based on the latent image; and transferring the inked image to a print substrate.

17. The method of claim 15, further comprising selectively switching the heating elements via active matrix addressing.

18. The method of claim 15, further comprising providing Step b) before Step a).

19. The method of claim 15, the digital image forming device further including a rotatable reimageable imaging member in rolling contact with the rotatable reimageable latent imaging roll, the rotatable reimageable latent imaging roll transferring the latent image of fluid onto the rotatable reimageable imaging member via rolling interaction therebetween.

20. The method of claim 15, the step c) further comprising modifying the deposited fluid layer over the rotatable reimageable latent imaging roll surface via evaporation to produce the latent image of fluid on the rotatable reimageable latent imaging roll based on the patterned image.

21. The device of claim 1, wherein the heated patterned image is configured to modify the deposited fluid over the rotatable reimageable latent imaging roll via evaporation to produce the latent image of fluid on the rotatable reimageable latent imaging roll surface based on the patterned image.

22. A digital image forming device useful for ink printing with an ink-based digital printing system having a rotatable reimageable latent imaging roll, comprising:

a heating array disposed as a layer of the rotatable reimageable latent imaging roll proximate an outer surface of the latent imaging roll, the heating array including a pixelated array of controllable heating elements spread about the layer, with each heating element corresponding to a respective pixel of the pixelated array, wherein a fluid is deposited over the rotatable reimageable latent imaging roll;

driving circuitry communicatively connected to the heating array for selectively temporarily heating the heating elements in a patterned image to an elevated temperature;

the selectively temporarily heated heating elements configured to heat portions of the rotatable reimageable latent imaging roll outer surface proximate the heating array as a heated patterned image when the selected heating elements are at the elevated temperature, the heated patterned image configured to modify the deposited fluid over the rotatable reimageable latent imaging roll to produce a latent image of fluid on the rotatable reimageable latent imaging roll surface based on the patterned image;

an inking apparatus configured to apply ink to the latent image and produce an inked image based on the patterned image; and an ink transfer nip for transferring the inked image to a print substrate.

23. The device of claim 22, wherein the heated patterned image is configured to modify the deposited fluid over the rotatable reimageable latent imaging roll via evaporation to produce the latent image of fluid on the rotatable reimageable latent imaging roll surface based on the patterned image.

* * * * *